US012693090B2

(12) United States Patent
McWilliam et al.

(10) Patent No.: US 12,693,090 B2
(45) **Date of Patent: *Jul. 28, 2026**

(54) ACTIVE FIREARM RECOIL REDUCTION SYSTEM

(71) Applicant: Jamie George McWilliam, Hamilton, MT (US)

(72) Inventors: Jamie George McWilliam, Hamilton, MT (US); Charles Edmond McWilliam, Sr., Hamilton, MT (US)

(73) Assignees: Jamie McWilliam, Hamilton, MT (US); Charles McWilliam, Hamilton, MT (US)

( * ) Notice: Subject to any disclaimer, the term of this patent is extended or adjusted under 35 U.S.C. 154(b) by 46 days.

This patent is subject to a terminal disclaimer.

(21) Appl. No.: 18/892,562

(22) Filed: Sep. 23, 2024

(65) Prior Publication Data

US 2026/0092754 A1 Apr. 2, 2026

Related U.S. Application Data

(60) Continuation of application No. 18/468,689, filed on Sep. 16, 2023, now Pat. No. 12,140,393, which is a division of application No. 17/666,150, filed on Feb. 7, 2022, now Pat. No. 11,828,558.

(60) Provisional application No. 63/225,059, filed on Jul. 23, 2021.

(51) Int. Cl.

| | |
|---|---|
| ***F41A 25/16*** | (2006.01) |
| ***F41A 25/02*** | (2006.01) |
| ***F41A 25/10*** | (2006.01) |

(52) U.S. Cl.
CPC ..... *F41A 25/16* (2013.01); *F41A 25/02* (2013.01); *F41A 25/10* (2013.01)

(58) Field of Classification Search
CPC ..... F41A 25/16; F41A 25/02; F41A 25/10; F41A 25/18; F41A 25/04; F41A 25/20; F41A 25/00; F41C 23/06
USPC ..... 89/42.01, 43.01, 1.701, 1.703; 42/1.06
See application file for complete search history.

(56) References Cited

U.S. PATENT DOCUMENTS

| | | | | |
|---|---|---|---|---|
| 4,910,904 | A * | 3/1990 | Rose | F41C 23/06 42/74 |
| 7,669,356 | B2 * | 3/2010 | Joannes | F41A 19/01 42/1.03 |
| 8,161,863 | B1 * | 4/2012 | Haas | F41A 13/06 89/193 |
| 10,088,266 | B1 * | 10/2018 | Fournerat | F41C 23/06 |
| 11,828,558 | B2 * | 11/2023 | McWilliam | F41A 25/02 |
| 2007/0234897 | A1 * | 10/2007 | Poff, Jr. | F41A 3/94 89/198 |
| 2010/0281726 | A1 * | 11/2010 | Lounsbury | F41G 3/12 42/1.06 |
| 2011/0126622 | A1 * | 6/2011 | Turner | F41A 19/01 73/514.01 |
| 2015/0377583 | A1 * | 12/2015 | Furusho | F41A 3/56 42/1.06 |

(Continued)

*Primary Examiner* — John Cooper
(74) *Attorney, Agent, or Firm* — Jamie McWilliam

(57) ABSTRACT

The present invention relates to an active system configured to apply an active force to a portion of a firearm designed to contact a body of the firearm's operator, to reduce the perceived recoil of the firearm. The active system includes an actuation element capable of generating an active force, and systems for powering and selectively operating the actuation element.

17 Claims, 7 Drawing Sheets

(56) References Cited

U.S. PATENT DOCUMENTS

2021/0025669 A1* 1/2021 Griffin ..... F41C 23/06

* cited by examiner

ACTIVE FIREARM RECOIL REDUCTION SYSTEM

CROSS REFERENCE TO RELATED APPLICATIONS

This application is a continuation of U.S. application Ser. No. 18/468,689, filed Sep. 16, 2023, which is a divisional of U.S. application Ser. No. 17/666,150, filed Feb. 7, 2022, which claims the benefit of U.S. Provisional Application No. 63/225,059, filed Jul. 23, 2021, entitled "ACTIVE FIREARM RECOIL REDUCTION SYSTEM", each of which is hereby incorporated by reference in its entirety.

BACKGROUND

An active system may use an actuation element attached to a portion of a firearm designed to contact a body of the firearm's operator, for example a stock or grip, to reduce the perceived recoil of the firearm. For example, gas from the firearm's barrel may be used to power an actuator that operates to apply a force on a stock or grip that opposes the recoil force.

SUMMARY

Some embodiments relate to an active system capable of reducing the perceived recoil of a firearm. The active system includes an actuation element capable of applying an active force to a part of the firearm designed to contact the firearm's operator, such as a stock or grip. The active force is applied to oppose the recoil force caused by firing the firearm. The active system also includes a gas tube connecting the firearm's barrel to the actuation element. The gas tube is connected to at least one accumulator. The gas tube also has a triggering mechanism to allow or block fluid flow through the gas tube and a one-way valve allowing fluid flow from the barrel to the accumulator.

Some embodiments relate to an active system where the triggering mechanism includes a valve and a trigger of the firearm. Squeezing the trigger of the firearm not only fires the firearm, but operates the valve, allowing fluid flow from the accumulator to the actuation element. In some embodiments, the accumulator(s) is one of an expandable bladder, a gas-charged accumulator, or an accumulator with a compressible element.

Some embodiments relate to an active system where the actuation element includes a piston inside a cylinder, a spring that applies a mechanical force to one face of the piston, and a port in the cylinder connected to the gas tube that allows fluid pressure to be applied to the other face of the piston, opposing the spring's mechanical force. In some embodiments, the actuation element includes an actuator with a piston inside a cylinder, a pump connected to the actuator, a motor that drives the pump, and at least one actuation accumulator in fluid communication with both the actuator and the pump. In some embodiments, the actuation element also includes a valve that allows the pump to supply fluid pressure to either of the piston faces selectively. In some embodiments, the actuation accumulator(s) is one of an expandable bladder, a gas-charged accumulator, or an accumulator with a compressible element. In some embodiments, the motor is one of a turbine motor, a vane motor, or a piston motor. In some embodiments, the pump is one of a gear pump, a screw pump, a turbine pump, a gerotor, a vane pump, a centrifugal pump, or a piston pump.

Some embodiments relate to an active system capable of reducing the perceived recoil of a firearm that includes an actuation element capable of applying an active force to a part of the firearm designed to contact the firearm's operator, such as a stock or grip. The active force is applied to oppose the recoil force caused by firing the firearm. The active system also includes a battery, an activating sensor, at least one auxiliary sensor, and an electronic control unit that uses inputs from the activating sensor and auxiliary sensor(s) to operate the actuation element.

Some embodiments relate to an active system where the actuation element includes a piston inside a cylinder, an electric pump in fluid communication with the cylinder and capable of applying fluid pressure to the piston, and at least one accumulator in fluid communication with both the cylinder and the electric pump. In some embodiments, the electric pump is one of a gear pump, a screw pump, a turbine pump, a gerotor, a vane pump, a centrifugal pump, or a piston pump. In some embodiments, the actuation element also includes a valve that allows the pump to supply fluid pressure to either of the piston faces selectively. In some embodiments the actuation element is one of a screw actuator, an electromagnetic actuator, a piezoelectric actuator, a linear electric actuator, and a rotary electric actuator. In some embodiments, the activating sensor is capable of delivering a signal to the electronic control unit in response to a mechanical input. In some embodiments the auxiliary sensor(s) is one of a sensor that senses a recoil force of operating the firearm or a sensor that senses the gas pressure within the firearm's barrel. In some embodiments, the actuation element also includes a spring element.

Some embodiments relate to a method of reducing the perceived recoil of a firearm. The method includes firing the firearm, determining the recoil force of the firearm, and applying an active force to a part of the firearm designed to contact the firearm's operator, such as a stock or grip. The active force opposes the recoil force, and is tuned so that the resultant sum of the two forces has a magnitude less than that of the recoil force. In some embodiments, the active force has a magnitude equal to the magnitude of the recoil force. In some embodiments, the active force has a magnitude less than the magnitude of the recoil force.

DETAILED DESCRIPTION

Newton's Third Law states that for every force there is an equal and opposite force. Typical operation of a firearm involves a variation of the following process: a firing pin strikes a primer, which in turn ignites propellent, causing expanding gas to exert a force on a bullet, propelling it down a barrel and towards a target. However, the expanding gas also causes an opposing force to be exerted on the firearm, pushing it back against the shooter. This is typically known as recoil.

Recoil may cause harm to the shooter after repeated use, particularly when ammunition with large amounts of propellant is used. This may be the case with large-caliber ammunition, or with ammunition designed with a high amount of propellant per the weight of the bullet, typically called a "magnum" round. Harm may come in the form of bruises or other discomfort.

Recoil may also affect the accuracy and precision of firearm shots. It may directly affect shots through the motion imparted on the firearm by the recoil force, thereby moving the barrel in an unintended direction. It may also affect the accuracy and precision of shots by fatiguing the shooter, causing them to be less precise when operating the firearm.

A solution to this problem may involve the use of an active system in the firearm stock, grip, or elsewhere on the firearm. While a passive system, such as a recoil pad, may lessen perceived recoil by damping the recoil force (in other words, it may operate in two of four quadrants of a force-velocity diagram), an active system is one that can exert a particular force opposing the recoil force and recoil motion (in other words, it may operate in at least three of four quadrants of a force-velocity diagram). By exerting an active force approximately or equally opposing the recoil force, the perceived recoil to the shooter can be lessened or approximately eliminated.

In some embodiments, the active force may be applied hydraulically. Conversely, in some embodiments, the active force may be applied pneumatically. The active force may also be applied, in some embodiments, by a pre-loaded spring, or by any other means sufficient to apply an active force opposing the recoil force. In some embodiments, the active force may be driven by the expanding gas of the burning propellant, or it may be driven electrically, or it may be driven manually, such by pre-loading a spring, or it may be driven by any other suitable means. The active system may include an input that triggers the system to exert a force. In some embodiments, the input may be a sensor on the trigger. The input may also be a gas sensor in the barrel, or any other means capable of determining that a shot has been fired and activating the active system.

Figure 1:
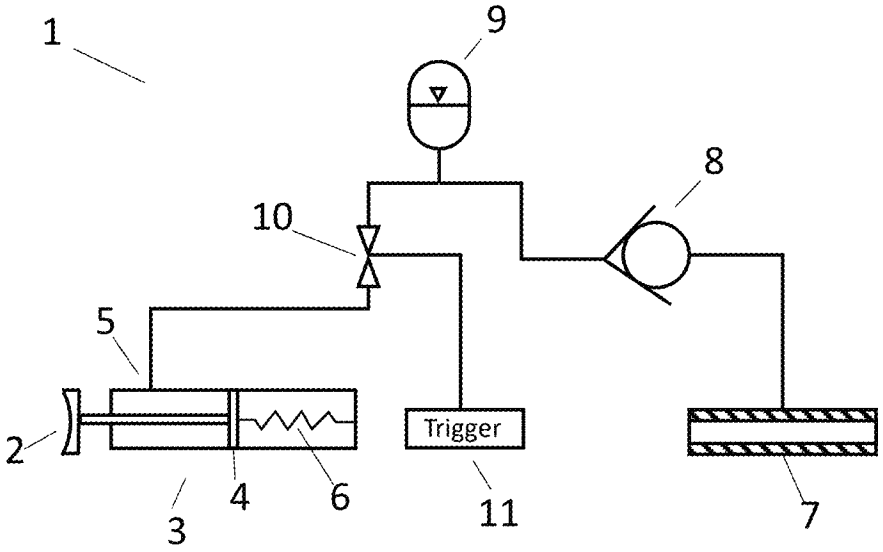
FIG. 1 is a schematic representation of an active firearm recoil reduction system with a gas-driven actuator.

Referring to FIG. 1, a firearm may include an active system 1. In one embodiment, the stock of the firearm 2 may attach to an actuator 3. The actuator 3 may be separated by a piston 4 into two chambers. One or more chambers may have a port 5, allowing it to be in fluid communication with the rest of the active system. When fluid enters the port 5, it may apply pressure to the piston 4, retracting the stock 2. When pressure is released, a spring 6 may be used in an embodiment to return to the piston 4, and subsequently the stock 2, to its un-retracted position.

In an embodiment, the fluid pressure required to operate the actuator may be supplied by the expanding gas within the barrel 7 from the burning propellant. In such an embodiment, the gas may travel from the barrel 7 to a one-way valve 8, such as a check valve, into an accumulator 9. Any device that permits fluid flow from the barrel 7 to the accumulator 9, but restricts flow from the accumulator to the barrel may operate in place of the one-way valve 8, including passive check valves or active valves that open to allow gas to enter the accumulator 9 but close once the accumulator 9 is fully charged. The accumulator 9 may allow fluid pressure to be stored for ready use when the system is activated. The accumulator 9 may be gas-charged, or include a compressible element, or maintain fluid pressure through another suitable means, such as an expandable bladder. A valve 10 may then be used to activate the system. The valve 10 may be controlled by the trigger 11, such that it supplies pressure to the actuator 3 as soon as the trigger 11 is pulled, by a force sensor capable of sensing when the firearm is fired, or it may be operated in another suitable means such that fluid communication is created between the accumulator 9 and the actuator 3 when the firearm is fired. The valve 10 may be mechanically operated, by a direct linkage to the trigger, or other means, or it may be electrically operated, by an electric system capable of sensing an activating event and subsequently opening the valve. An activating event may be pulling the trigger, the application of recoil force to the firearm, or any other event associated with the operation of a firearm. When the valve 10 is opened, the fluid pressure stored in the accumulator 9 may expand into the actuator 3, compressing the spring element 6 by moving piston 4 and retracting the stock 2. After the system has been activated, the spring element 6 may return the stock 2 to its unretracted position, and the fluid pressure may be released through any appropriate means, such as a venting port, valve, or other suitable means.

In one embodiment, when a shooter squeezes the trigger 11, the actuator 3 retracts the stock 2, with a force approximately equal to the recoil force. For example, if the recoil applies a 80 N force on the stock 2 in one direction, then the actuator 3 may apply an active force of approximately 80 N in an opposite direction, bringing the net force on the stock 2 to approximately 0 N. This is because forces may be summed across a body, where: $F_{net}=\Sigma F=F_1+F_2+F_3 \ldots$. In this example, the appropriate sum would be: $F_{net}=80N-80N=0N$. The actuator 3 may be tuned to achieve the desired amount of recoil reduction. If the active force is less than the recoil force (in the above example, if it is less than 10 N), then the recoil will be reduced but not eliminated. This may be desirable if the shooter prefers to obtain feedback (recoil) from the operation of a firearm, but not so much as to be bruised or otherwise harmed by it.

In this example, for an AR-15 shooting a standard 5.56 round, the recoil force may be approximately 80 N, though other values are also common, and the disclosure is not so limited. For a piston 4 area of 25 sq-cm, to achieve a force on the piston of 80 N, a pressure of 32 kPa is required. For AR-15s, gas pressures in the range of 290-400 MPa are common, thus providing sufficient fluid pressure to apply the requisite active force. Any excess gas pressure may be bled, or used to cycle the bolt on a semi-automatic firearm such as the AR-15.

Depending on the particular embodiment, the entire active system 1 may be contained within a housing within, or integrated with, the stock. This may allow for an integrated stock unit that can be attached to a pre-existing firearm regardless of design or construction. Alternatively, various components of the system may be located elsewhere on the firearm. For example, the accumulator 9 may be mounted closer to the barrel 7 to reduce fluid drag from the gas tube to the accumulator 9. Similarly, other components, such as the valve 10 may be located on the receiver, within the grip, or any other suitable location.

Figure 2:
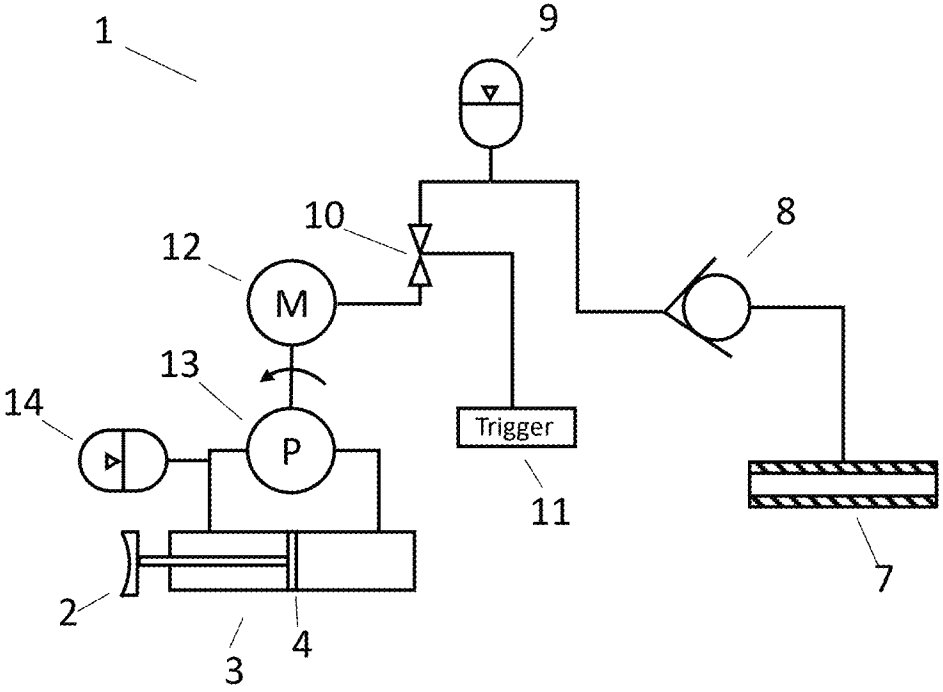
FIG. 2 is a schematic representation of an active firearm recoil reduction system with an actuator driven by a two-port pump.
Figure 3:
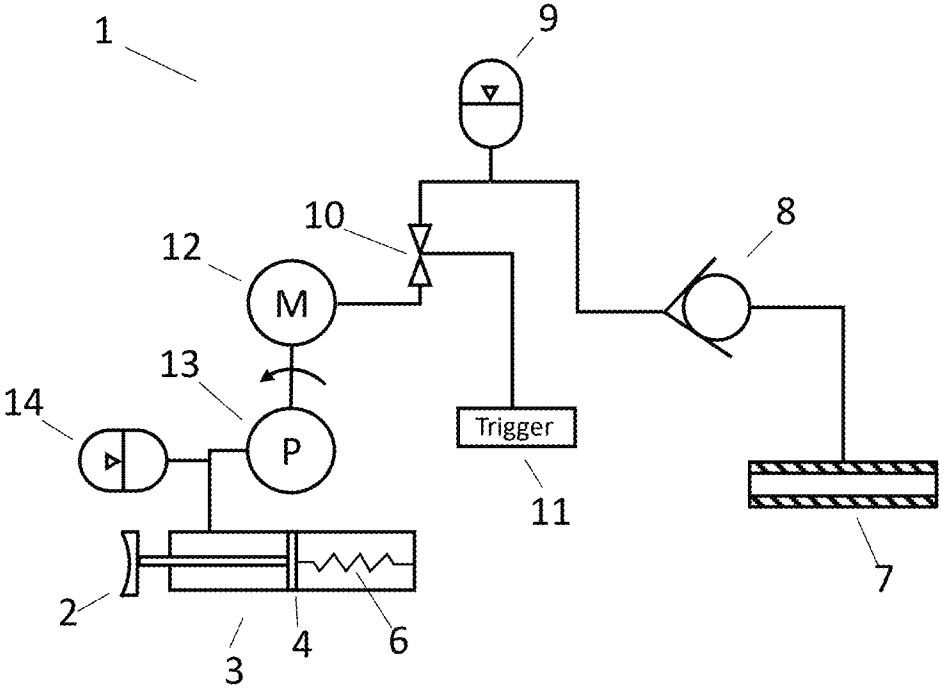
FIG. 3 is a schematic representation of an active firearm recoil reduction system with an actuator driven by a single-port pump and a spring-return system.

FIGS. 2 and 3 depict embodiments where the gas from the barrel 7 may be used to power a motor 12. The motor 12 may drive a pump 13, which may supply fluid pressure to the actuator 3. The motor 12 may be a turbine motor, vane motor, piston motor, or any other type of motor capable of using pressurized gas to produce mechanical work. The pump 13 may be a gear pump, screw pump, turbine pump, or any other type of pump capable of applying pressure to the piston 4 of the actuator 3.

An accumulator 14 may be used between the pump 13 and the actuator 4 to damp any fluid vibrations and accommodate changes in pressure. The accumulator 14 may be gas-charged, or include a compressible element, or maintain fluid pressure through another suitable means, such as an expandable bladder. The pump 13 may have two ports, such that it is in fluid communication with both chambers of the actuator 3, as in FIG. 2, or it may have a single port, as in FIG. 3. If a single port is used, then the pump 13 may include a fluid reservoir, and a spring element 6 may be used to return the stock 2 to its unretracted position.

In an embodiment, the fluid pressure required to operate the motor 12 may be supplied by the expanding gas within the barrel 7 from the burning propellant. In such an embodiment, the gas may travel from the barrel 7 to a one-way valve 8, such as a check valve, into an accumulator 9. Any device that permits fluid flow from the barrel 7 to the accumulator 9, but restricts flow from the accumulator to the barrel may operate in place of the one-way valve 8, including passive check valves or active valves that open to allow gas to enter the accumulator 9 but close once the accumulator 9 is fully charged. The accumulator 9 may allow fluid pressure to be stored for ready use when the system is activated. The accumulator 9 may be gas-charged, or include a compressible element, or maintain fluid pressure through another suitable means, such as an expandable bladder. When a shooter squeezes the trigger 11, the valve 10 may open, allowing pressurized gas stored in the accumulator 9 to drive the motor 12. The valve 10 may be mechanically operated, by a direct linkage to the trigger, or other means, or it may be electrically operated, by an electric system capable of sensing an activating event and subsequently opening the valve. An activating event may be pulling the trigger, the application of recoil force to the firearm, or any other event associated with the operation of a firearm. The motor 12 may drive the pump 13, applying pressure to the piston 4 of the actuator 3, retracting the stock 2 with a force approximately equal to the recoil force. This may reduce or approximately eliminate the net force on the stock 2 that is transferred to the shooter. Once the stock 2 has been retracted and the valve 10 closes, the gas from the fired round may enter through the one-way valve 8, and be stored under pressure in the accumulator 9. After the recoil force has passed, the stock 2 may be returned to its unretracted position by fluid pressure operating on the piston 4, as in the embodiment of FIG. 2, by mechanical force, such as from a spring as in FIG. 3, or it may be returned to its unretracted position by hand or by any other suitable means.

While a specific embodiment is described above, it should be understood that embodiments integrating various types of valves, accumulators, motors, and/or pumps are also possible as the disclosure is not so limited. The actuator 3 is depicted in FIGS. 2 and 3 as a hydraulic or pneumatic actuator powered by a pump 13. Alternatively, any other type of actuator capable of exerting an active force in response to an input signal may be used, such as a screw actuator, an electromagnetic actuator, a piezoelectric actuator, or any other suitable type of actuator, and the disclosure is not so limited.

As noted above, the active system 1 includes a motor 12 operatively coupled to a pump 13. The motor 12 may either be directly or indirectly coupled to the pump 13 as the disclosure is not so limited. In either case, the motor 12 directly or indirectly applies a force and/or torque to the pump 13. The pump 13 may be operated bidirectionally, though it may also be possible to operate the pump 13 in a single direction using appropriate valving. It should be understood that any motor 12, pump 13, and coupling might be used. For example, the pump 13 may be any device capable of functioning as a hydraulic pump or a hydraulic motor including, for example, a gerotor, vane pump, internal or external gear pump, high torque/low speed gerotor motor, turbine pump, centrifugal pump, axial piston pump, or bent axis pump. In embodiments where the pump 13 is a gerotor, the assembly may be configured so that the root and/or tip clearance can be easily adjusted so as to reduce backlash and/or leakage between the inner and outer gerotor elements. However, embodiments without such a feature are also contemplated.

In addition to the various types of motors 12 and pumps 13, the coupling between the motor 12 and pump 13 may be any appropriate coupling. For example, a shaft might be used, or it may include one or more devices such as a clutch to alter the torque transferred, a shock-absorbing device such as a spring pin, a cushioning/damping device, a combination of the above, or any other appropriate arrangement capable of coupling the motor 12 to the pump 13. In some embodiments, in order to decrease response times, it may be desirable to provide a relatively stiff coupling between the motor 12 and the pump 13. In one such embodiment, a short shaft may be used. Depending on the particular embodiment, the coupling may also incorporate features, such as spring pins, that reduce backlash between the motor 12 and pump 13.

In shooting applications, it may be desirable for the active system to have a fast response time. However, the inertia of the active system and its components may impact the ability to respond quickly due to inertial forces limiting the response of the system. Thus, it may be desirable to mitigate the impact of the inertia on a response of the active system in some embodiments. This may be accomplished through the use of low inertia materials, such as engineered plastic, or through design features such as an inertia buffer, or optimizing the geometry of components to limit their inertia. Other methods are also contemplated, and this disclosure is not so limited.

Depending on the particular embodiment, the entire active system 1 may be contained within a housing within, or integrated with, the stock. This may allow for an integrated stock unit that can be attached to a pre-existing firearm regardless of design or construction. Alternatively, various components of the system may be located elsewhere on the firearm. For example, the accumulator 9 may be mounted closer to the barrel 7 to reduce fluid drag from the gas tube to the accumulator 9. Similarly, other components, such as the valve 10, motor 12, and/or pump 13, may be located on the receiver, within the grip, or any other suitable location.

Figure 4:
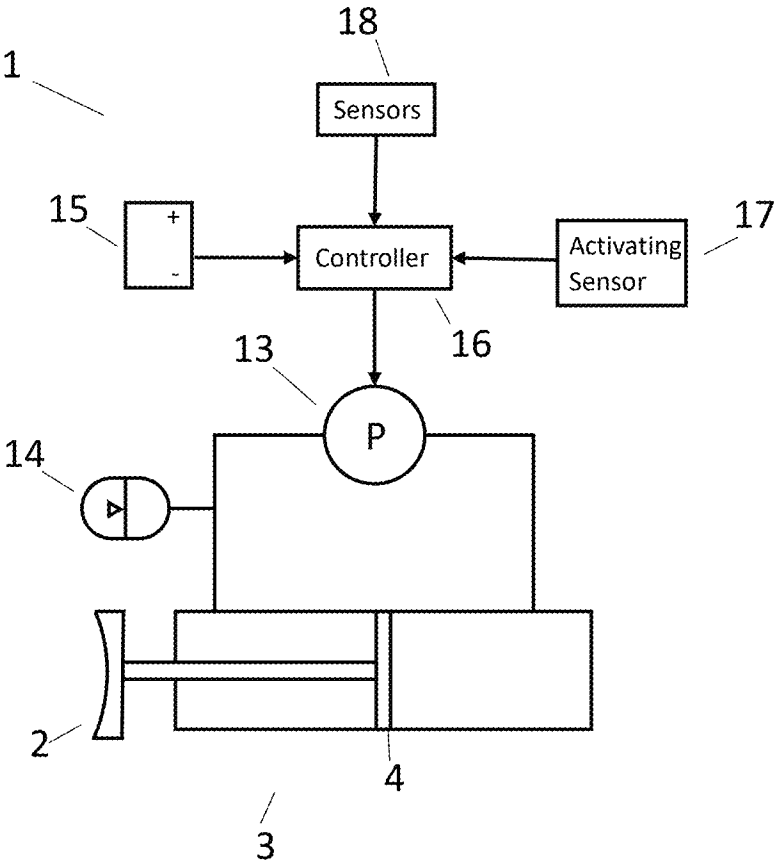
FIG. 4 is a schematic representation of an active firearm recoil reduction system with an electronically controlled actuator.
Figure 5:
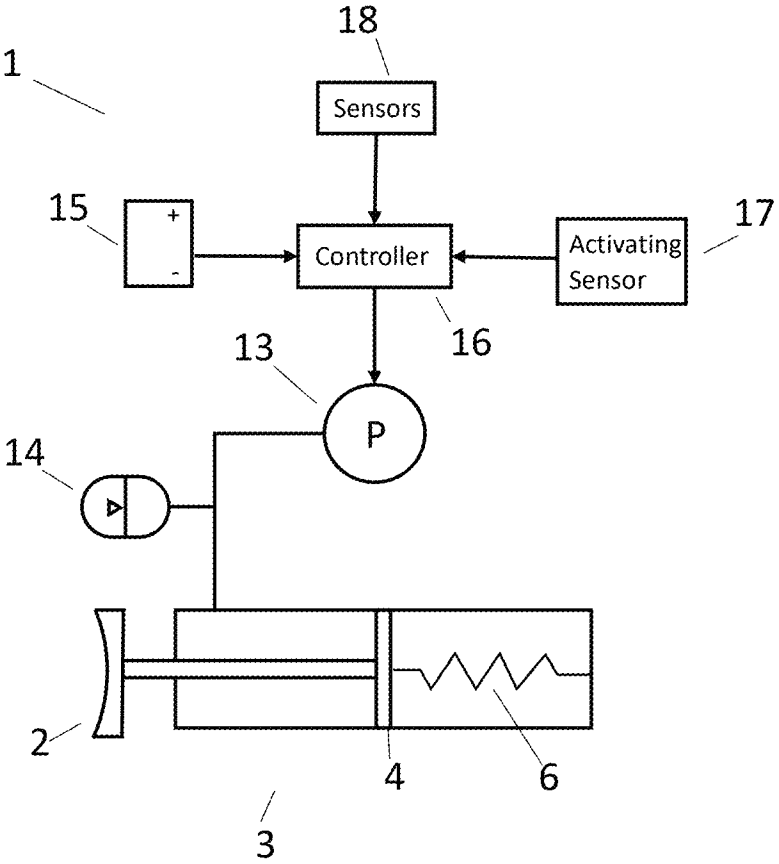
FIG. 5 is a schematic representation of an active firearm recoil reduction system with an electronically controlled actuator and spring-return system.

Referring to FIGS. 4 and 5, the active system 1 may be electronically controlled. In one embodiment, a battery 15 may provide the energy to run the active system 1. A controller 16 may accept input from an activating sensor 17, such as one on the firearm's trigger, and any other sensors 18 that may provide information to the controller 16 as to the operation of the firearm. In at least one embodiment, the other sensors 18 may include recoil force sensors, barrel pressure sensors, or any other sensor capable of outputting information relating to the operation of the firearm. The controller 16 may use inputs from the sensors 18 to determine an appropriate output, such that when the activating sensor 17 is triggered, the controller 16 causes the electrically driven pump 13 to exert a force on the piston 4, and subsequently on the stock 2, that reduces or approximately eliminates the recoil force perceived by the shooter.

The electrically driven pump 13 may be a gear pump, screw pump, turbine pump, or any other type of pump capable of applying pressure to the piston 4 of the actuator 3. An accumulator 14 may be used between the pump 13 and the actuator 3 to damp any fluid vibrations and accommodate changes in pressure. The accumulator 14 may be gas-charged, or include a compressible element, or maintain fluid pressure through another suitable means, such as an expandable bladder. The electrically driven pump 13 may have two ports, such that it is in fluid communication with both chambers of the actuator 3, as in FIG. 4, or it may have a single port, as in FIG. 5. If a single port is used, then the pump 13 may include a fluid reservoir, and a spring element 6 may be used to return the stock 2 to its unretracted position.

The actuator 3 is depicted in FIGS. 4 and 5 as a hydraulic or pneumatic actuator powered by an electrically driven pump 13. Alternatively, any other type of actuator capable of exerting an active force in response to an input signal may be used, such as a screw actuator, an electromagnetic actuator, a piezoelectric actuator, or any other suitable type of actuator, and the disclosure is not so limited.

In one embodiment, a shooter may squeeze the trigger, causing the trigger sensor or other activating sensor 17 to send a signal to the controller 16. The controller then uses inputs from the other sensors 18 to create an output for the actuator 3. For example, the controller 16 may create an expected output based on typical recoil forces. Then, if the sensors 18 includes a recoil force sensor, the controller 16 may adjust its output to the actuator 3 such that the actuator exerts a force more closely opposing the recoil force. The other sensors 18 may also be used to determine if a shot has actually been fired. If not, then the controller 16 may be programmed to not send the output signal to the actuator 3. This way, in the case of a dry fire, the actuator 3 may not cause the stock 2 to retract. In an embodiment, once a shot has been fired, the controller 16 may send an output to the actuator 3 such that it returns the stock 2 to its unretracted position. In an embodiment, a passive return system, such as the spring element 6 depicted in FIG. 5, may be used to return the stock 2 to its unretracted position after firing.

While a specific embodiment is described above, it should be understood that embodiments integrating various types of valves, accumulators, motors, and/or pumps are also possible as the disclosure is not so limited. For example, the pump 13 may be any device capable of functioning as a hydraulic pump or a hydraulic motor including, for example, a gerotor, vane pump, internal or external gear pump, high torque/low speed gerotor motor, turbine pump, centrifugal pump, axial piston pump, or bent axis pump. In addition to the above, the pump 13 may be driven by any appropriate device including a brushless DC motor such as a three-phase permanent magnet synchronous motor, a brushed DC motor, an induction motor, a dynamo, or any other type of device capable of converting electricity into rotary motion and/or vice-versa.

As noted above, the active system 1 includes a controller 16 capable of delivering an output signal to a pump 13. Further, the pump 13 may either actively drive the actuator 3 or it may act as a generator to provide damping to the hydraulic actuator while also generating energy that may either be stored in the battery 15 for future use or dissipated. If the pump 13 is back driven as a generator, the pump 13 is driven by fluid flowing between the two volumes of the actuator 3 in response to a force applied to the stock 2. Then the pump 13 may produce electrical energy, which is then stored in the battery 15. By controlling an impedance, or other appropriate input, applied to the pump 13 during generation, the damping force applied to the actuator 3 may be electronically varied. Even if an active force is applied to the stock 2, electric energy may be produced during the reset of the stock's 2 position by a spring element 6, or by other suitable means. In this way, each cycle of the active system 1 may first exert energy to retract the stock 2, and then generate energy when the stock 2 is reset to its unretracted position, thus prolonging the use of the active system 1 on a single charge.

In one embodiment, an extension length of the actuator 3 may be determined by a rotational position of the pump 13. Consequently, depending on how the pump 13 is controlled, the actuator piston 4 may be held still, or actively moved in either direction. This position data may be input into the controller 16, and used to increase the accuracy of the generation of the active force. For example, if the stock 2 has not been fully reset when the active system 1 is activated, then this may be noted by the controller 16, and the active force can be adjusted accordingly.

Figure 6:
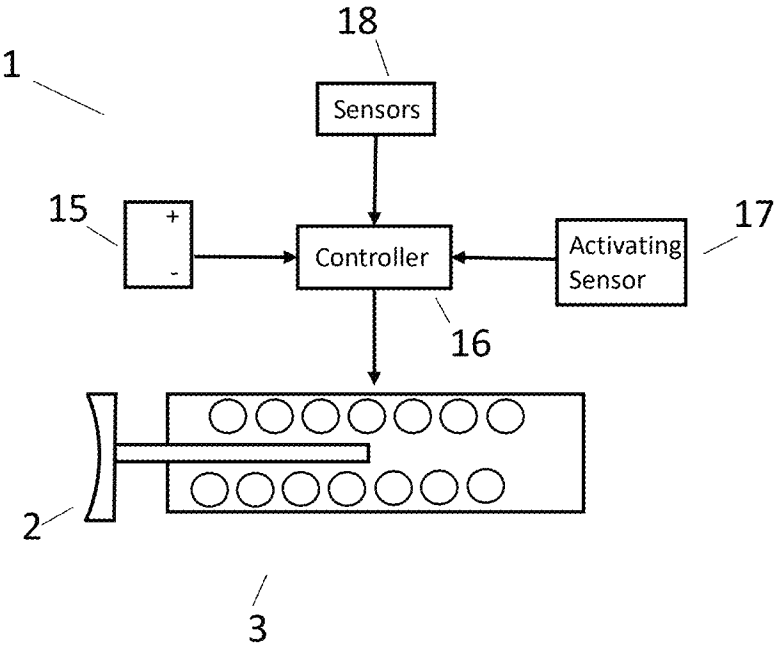
FIG. 6 is a schematic representation of an active firearm recoil reduction system with an electronically controlled electromagnetic actuator.

In another embodiment, as in FIG. 6, an electromagnetic actuator may be used. The electromagnetic actuator may be used to generate an active force to the stock 2. However, if the battery 15 power is low, it may also be used to generate power. Even if an active force is applied to the stock 2, electric energy may be produced during the reset of the stock's 2 position. In this way, each cycle of the active system 1 may first exert energy to retract the stock 2, and then generate energy when the stock 2 is reset to its unretracted position, thus prolonging the use of the active system 1 on a single charge. This same feature may be accomplished through the use of a dual pump/generator coupled with a hydraulic or pneumatic actuator, or any other method of converting mechanical work into electric energy, and the disclosure is not so limited.

In shooting applications, it may be desirable for the active system to have a fast response time. However, the inertia of the active system and its components may impact the ability to respond quickly due to inertial forces limiting the response of the system. Thus, it may be desirable to mitigate the impact of the inertia on a response of the active system in some embodiments. This may be accomplished through the use of low inertia materials, such as engineered plastic, or through design features such as an inertia buffer, or optimizing the geometry of components to limit their inertia. In another embodiment, the controller 16 may utilize an algorithm to predict the inertia of the pump 13, actuator piston 3, or other components, and account for the inertia in such a way that it does not affect the recoil force transmitted to the shooter. Other methods are also contemplated, and the disclosure is not so limited.

Depending on the particular embodiment, the entire active system 1 may be contained within a housing within, or integrated with, the stock. This may allow for an integrated stock unit that can be attached to a pre-existing firearm regardless of design or construction. Alternatively, various components of the system may be located elsewhere on the firearm. For example, the controller 16, battery 15 and sensors 18 may be on the receiver, within the grip, or any other suitable location.

Figure 7:
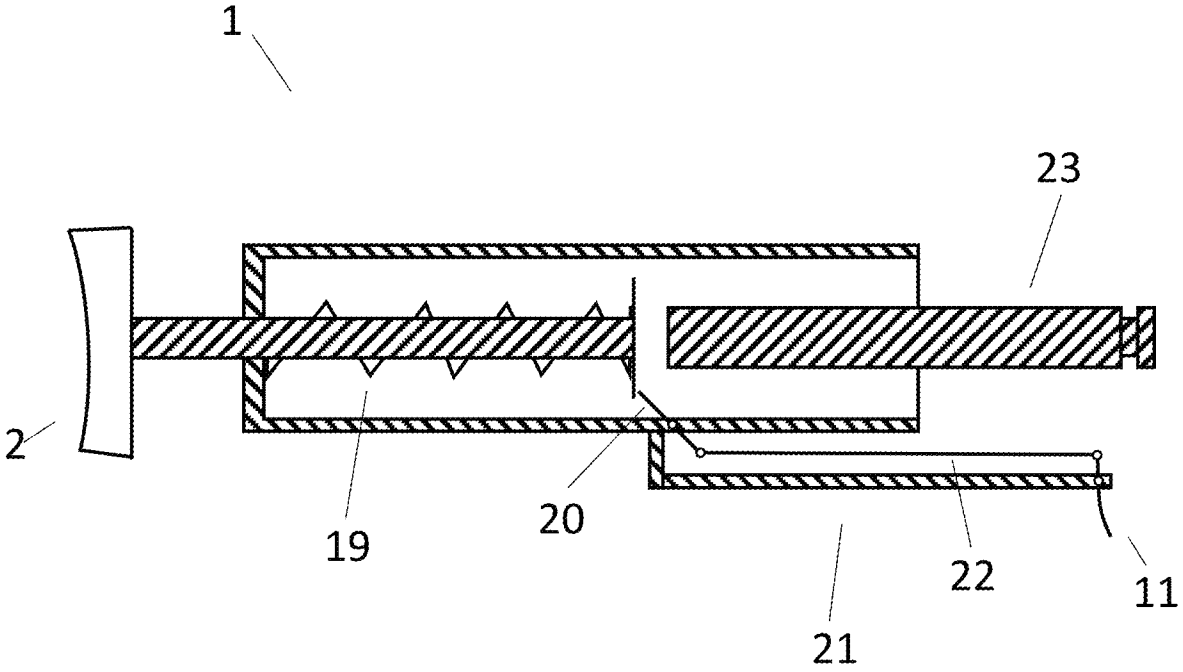
FIG. 7 shows a mechanically operated active firearm recoil reduction system.

Referring to FIG. 7, in one embodiment, the active system 1 may be mechanically powered and self-contained. A device capable of storing potential energy, such as a spring element 19, may apply a force to the stock 2 when released by a releasing mechanism 20. A mechanical activating system 21 may be used to activate the system. In an embodiment, the mechanical activating system 21 may include a linkage 22 connecting the trigger 11 with the releasing mechanism 20. In another embodiment, an electronic activating system may be used, such that the releasing mechanism 20 is released in response to motion of the trigger, acceleration on the firearm, or any other suitable activating event.

In an embodiment, a shooter may squeeze the trigger 11, causing the mechanical activating system 21 to activate the releasing mechanism 20. This releases the spring element 19, which exerts a force on the stock 2 that may approximately oppose the recoil force. Once the stock 2 retracts under the force of the spring element 19, it may be reset to its unretracted position by sliding the bolt 23 back, pressing the stock 2 backwards and compressing the spring element 19. Once the spring element 19 has been fully compressed, the releasing mechanism 20 engages with the stock 2 and holds it in place until released by the releasing mechanism 20. In an embodiment, another resetting method may be used, such as using an actuator, or by manually resetting the stock 2, or by any other suitable method of returning the stock 2 to its unretracted position.

The spring element 19, or the distance through which the stock 2 moves when released, may be tuned to achieve an active force resulting in the desired amount of recoil force reduction. When a spring element 19 is used to achieve the active force through the release of potential energy, the active force may be modeled by the equation $F=k*x$, where k is the spring constant of the spring element 19, and x is the distance the spring element 19 is compressed. By using a spring element 19 with a higher or lower spring constant, the active force may be increased or decreased, respectively. Similarly, by compressing the spring element 19 more or less, a similar result may be achieved. In one embodiment, the stock 2 may have multiple locations on which the releasing mechanism 20 may engage, thereby allowing the active force to be tuned based off how far out the stock 2 is pulled. For example, if a shooter desires a recoil force to only be eliminated by half, rather than fully eliminated, they may reset the stock 2 to only half of its fully unretracted position, thus compressing the spring element 19 by half of its full compression, and decreasing the active force by half of its fully eliminating value. To compensate for the resulting change in stock length, the stock may be shortened or lengthened by employing any standard adjustable stock, such as a pinned collapsible stock or other suitable stock.

It may be recognized that many of the features of this invention are not limited to only one embodiment. For example, the active system 1 of FIG. 1 may use a mechanical activating system 21 similar to the one depicted in FIG. 6. In this example, the valve 10 may connect to a linkage 22 that allows the movement of the trigger 11 to mechanically operate the valve. The linkage 22 may be a rod, as in FIG. 6, or it may be a series of gears, or any other suitable means of transmitting the mechanical energy from the trigger 11 to the valve 10.

Similarly, the electronic system of FIGS. 4 and 5 may be powered using the gas tube system of FIGS. 1, 2, and 3. In one such embodiment, the gas from the barrel 7 may pass through a suitable one-way valve 8, into a suitable accumulator 9, then when power is needed, a valve 10 may open allowing the gas to power a suitable motor/generator 12. The motor/generator 12 may then deliver power either directly to the controller 16 or be stored in a battery 15 for future use. In an embodiment that does not utilize a battery, an alternative source of storing electric energy may be used to provide instantaneous electricity to the system, such as a capacitor. In such an embodiment, power may be stored in the capacitor such that when the activating sensor 17 activates the active system 1, the controller 16 can immediately provide electric current to the pump 13. By the time the capacitor has been depleted, the expanding gas from the barrel 7 may be driving the motor/generator 12 to provide the rest of the required energy.

While specific embodiments and examples and variations thereof have been described above, it may be recognized that other embodiments are within the scope of this invention. Thus, it is not intended that the present teachings be limited to such embodiments or examples. Instead, the present teachings encompass various alternatives, modifications, and equivalents, as will be appreciated by those of skill in the art.

The invention claimed is:

1. An active system for reducing a perceived recoil of a firearm, the active system comprising:

an actuation element, wherein the actuation element is configured to apply an active force onto a portion of the firearm designed to contact a body of the firearm's operator, wherein the active force is configured to oppose a recoil force caused by operation of the firearm, and wherein the actuation element is configured to cause the portion of the firearm designed to contact a body of the firearm's operator to retract; and a gas tube, wherein the gas tube is configured to transfer fluid pressure from a barrel of the firearm to the actuation element.

2. The active system of claim 1, wherein the actuation element comprises:

an outer cylinder;

a piston, wherein the piston divides the outer cylinder into a first chamber and a second chamber, wherein the piston has a first face and a second face, and wherein the second face opposes the first face;

a spring, wherein the spring is configured to apply a mechanical force to the first face of the piston;

at least one port in fluid communication with the gas tube; and wherein the at least one port is configured to transfer fluid pressure to the second face of the piston during operation of the active system.

3. The active system of claim 2, wherein the portion of the firearm designed to contact a body of the firearm's operator is a grip of the firearm.

4. The active system of claim 3, further comprising a one-way valve disposed within the gas tube, wherein the one-way valve is configured to allow fluid to flow from the barrel.

5. The active system of claim 4, further comprising a triggering mechanism, wherein the triggering mechanism is configured to selectively allow a fluid flow through the gas tube in response to an input.

6. The active system of claim 5, wherein the triggering mechanism comprises a valve and a trigger of the firearm, and wherein the valve is operated in response to an operation of the trigger.

7. The active system of claim 6, wherein the triggering mechanism further comprises:

a trigger sensor, wherein the trigger sensor is configured to produce an output when the trigger is operated;

a valve operation unit, wherein the valve operation unit is configured to operate the valve in response to an input; and wherein the valve operation unit is configured to receive as an input the output from the trigger sensor.

8. The active system of claim 2, wherein the portion of the firearm designed to contact a body of the firearm's operator is a stock of the firearm.

9. The active system of claim 8, further comprising a one-way valve disposed within the gas tube, wherein the one-way valve is configured to allow fluid to flow from the barrel.

10. The active system of claim 9, further comprising a triggering mechanism, wherein the triggering mechanism is configured to selectively allow a fluid flow through the gas tube in response to an input.

11. The active system of claim 10, wherein the triggering mechanism comprises a valve and a trigger of the firearm, and wherein the valve is operated in response to an operation of the trigger.

12. The active system of claim 11, wherein the triggering mechanism further comprises:

a trigger sensor, wherein the trigger sensor is configured to produce an output when the trigger is operated;

a valve operation unit, wherein the valve operation unit is configured to operate the valve in response to an input; and wherein the valve operation unit is configured to receive as an input the output from the trigger sensor.

13. The active system of claim 2, wherein the portion of the firearm designed to contact a body of the firearm's operator is an assembly comprising a stock of the firearm and a grip of the firearm.

14. The active system of claim 13, further comprising a one-way valve disposed within the gas tube, wherein the one-way valve is configured to allow fluid to flow from the barrel.

15. The active system of claim 14, further comprising a triggering mechanism, wherein the triggering mechanism is configured to selectively allow a fluid flow through the gas tube in response to an input.

16. The active system of claim 15, wherein the triggering mechanism comprises a valve and a trigger of the firearm, and wherein the valve is operated in response to an operation of the trigger.

17. The active system of claim 16, wherein the triggering mechanism further comprises:

a trigger sensor, wherein the trigger sensor is configured to produce an output when the trigger is operated;

a valve operation unit, wherein the valve operation unit is configured to operate the valve in response to an input; and wherein the valve operation unit is configured to receive as an input the output from the trigger sensor.

* * * * *